US007954738B2

(12) United States Patent
Lee et al.

(10) Patent No.: US 7,954,738 B2
(45) Date of Patent: Jun. 7, 2011

(54) ICE DISPENSER

(75) Inventors: Dong Hoon Lee, Incheon (KR); Wook Yong Lee, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 602 days.

(21) Appl. No.: 11/967,448

(22) Filed: Dec. 31, 2007

(65) Prior Publication Data

US 2008/0156018 A1 Jul. 3, 2008

(30) Foreign Application Priority Data

Dec. 31, 2006 (KR) ..... 10-2006-0139246

(51) Int. Cl.
*B02C 4/32* (2006.01)
*B02C 7/14* (2006.01)
*B02C 9/04* (2006.01)

(52) U.S. Cl. ..... 241/37; 241/DIG. 17

(58) Field of Classification Search ..... 241/235, 241/DIG. 17, 230, 236, 231, 37
See application file for complete search history.

(56) References Cited

U.S. PATENT DOCUMENTS

| | | | | | |
|---|---|---|---|---|---|
| 996,958 | A * | 7/1911 | Wallick | 241/41 |
| 2,235,968 | A * | 3/1941 | Thurman | 241/159 |
| 2,416,422 | A * | 2/1947 | Udden | 241/229 |
| 3,591,097 | A * | 7/1971 | Ough | 241/113 |
| 4,608,007 | A * | 8/1986 | Wood | 425/363 |
| 4,721,257 | A * | 1/1988 | Williams et al. | 241/36 |
| 4,752,038 | A * | 6/1988 | Takahashi et al. | 241/158 |
| 5,156,794 | A * | 10/1992 | Nakanishi et al. | 264/349 |
| 5,156,872 | A * | 10/1992 | Lee | 426/489 |
| 5,285,973 | A * | 2/1994 | Goforth et al. | 241/36 |
| 5,394,705 | A * | 3/1995 | Torii et al. | 62/74 |
| 5,395,057 | A * | 3/1995 | Williams et al. | 241/36 |
| 5,678,777 | A * | 10/1997 | Satake et al. | 241/227 |
| 6,439,486 | B1 * | 8/2002 | Nitta et al. | 241/29 |
| 6,579,950 | B2 * | 6/2003 | Nishioka et al. | 525/388 |
| 2002/0074438 | A1 * | 6/2002 | Horigane | 241/236 |

* cited by examiner

*Primary Examiner* — Bena Miller
(74) *Attorney, Agent, or Firm* — Fish & Richardson P.C.

(57) ABSTRACT

Provided is an ice dispenser. The ice dispenser dispenses ice pieces have various sizes such as chunks, fragments, and shavings to users, and the size of ice pieces discharged from the ice dispenser can be conveniently adjusted. The ice dispenser includes a rotatable first roller, a rotatable second roller disposed close to the first roller, and a distance adjustor. The distance adjustor is configured to adjust a distance between the first and second rollers for adjusting sizes of ice crushed between the first and second rollers.

12 Claims, 4 Drawing Sheets

ICE DISPENSER

BACKGROUND

The present disclosure relates to an ice dispenser capable of properly dispensing ice.

Refrigerators are widely used in various fields such as household applications and restaurant applications for providing low-temperature environments.

An increasing number of recent multifunctional refrigerants are equipped with an icemaker for making ice and an ice dispenser for dispensing ice made by the icemaker. In addition, the ice dispenser can discharge a desired amount of ice made by the icemaker after breaking the ice into small sizes that users want.

For breaking ice, the ice dispenser usually includes a fixed blade and a rotatable blade capable of rotating relative to the fixed blade. Ice place on the fixed blade can be crushed by rotating the rotatable blade relative to the fixed blade. Sometimes, finely crushed ice can be necessary. However, such a related-art ice dispenser cannot provide finely crushed ice although the related-art ice dispenser can provide ice chucks (ice cubes) or smaller ice fragments. Therefore, an ice dispenser capable of providing finely crushed ice is needed.

SUMMARY

Embodiments provide an ice dispenser that can dispense ice pieces having different sizes such as chunks, fragments, and shavings.

In one embodiment, an ice dispenser includes: an ice bank configured to store ice and including an ice outlet at a predetermined side; a driving unit capable of rotating in forward and reverse directions; and an ice crusher including a first roller and a second roller, wherein the ice crusher receives ice from the ice bank through the ice outlet and discharges the ice after crushing or not crushing the ice according to the rotation direction of the driving unit.

In another embodiment, an ice dispenser includes: a driving unit providing a torque; a first roller rotatable by the torque provided by the driving unit; a second roller rotatable by the torque provided by the driving unit; and a distance adjustor configured to adjust a distance between the first and second rollers for adjusting sizes of ice crushed between the first and second rollers.

In a further embodiment, an ice dispenser includes: a rotatable first roller; a rotatable second roller disposed close to the first roller; and a distance adjustor configured to adjust a distance between the first and second rollers for adjusting sizes of ice crushed between the first and second rollers.

The details of one or more embodiments are set forth in the accompanying drawings and the description below. Other features will be apparent from the description and drawings, and from the claims.

According to the present disclosure, the ice dispenser can dispense ice pieces have various sizes such as chunks, fragments, and shavings.

DETAILED DESCRIPTION OF THE EMBODIMENTS

An ice dispenser will now be described with reference to the accompanying drawings, in which embodiments of the present disclosure are shown. Before describing the ice dispenser, an exemplary refrigerator in which the ice dispenser can be used will be first described.

An icemaker is disposed in the refrigerator. The icemaker may be disposed in a freezer compartment of the refrigerator that is kept below 0°. However, the icemaker can be disposed on an inner side of a door for saving the space of the freezer compartment or a refrigerator compartment. In addition, the icemaker can be disposed at a predetermined place in the refrigerator compartment, and air having a temperature lower than 0° can be directed to the predetermined place. An ice bank is disposed under the icemaker. The ice bank stores ice made by the icemaker. The ice bank includes an opening for discharging ice stored therein. An ice carrying unit can be disposed in the ice bank for carrying ice to the opening, and a driving unit can be disposed in the ice bank for actuating the ice carrying unit. A dispenser is disposed at an outer wall of the refrigerator for providing ice discharged from the ice bank to users.

Meanwhile, an ice crusher can be used to crush ice chucks discharged from the ice bank into fragments or shavings before discharging the ice through the dispenser. Herein, the term "chunk" is used to denote the original state of ice made by the icemaker, such as ice cubes. The term "fragment" is used to denote crushed ice, and the term "shaving" is used to denote finely crushed ice.

The ice crusher may be disposed under the opening of the ice bank for crushing ice fallen from the opening.

In the following description, the ice dispenser is used in a refrigerator. However, the present disclosure is not limited thereto. That is, the ice dispenser of the present disclosure can be applied to any other apparatus capable of making ice.

Figure 1:
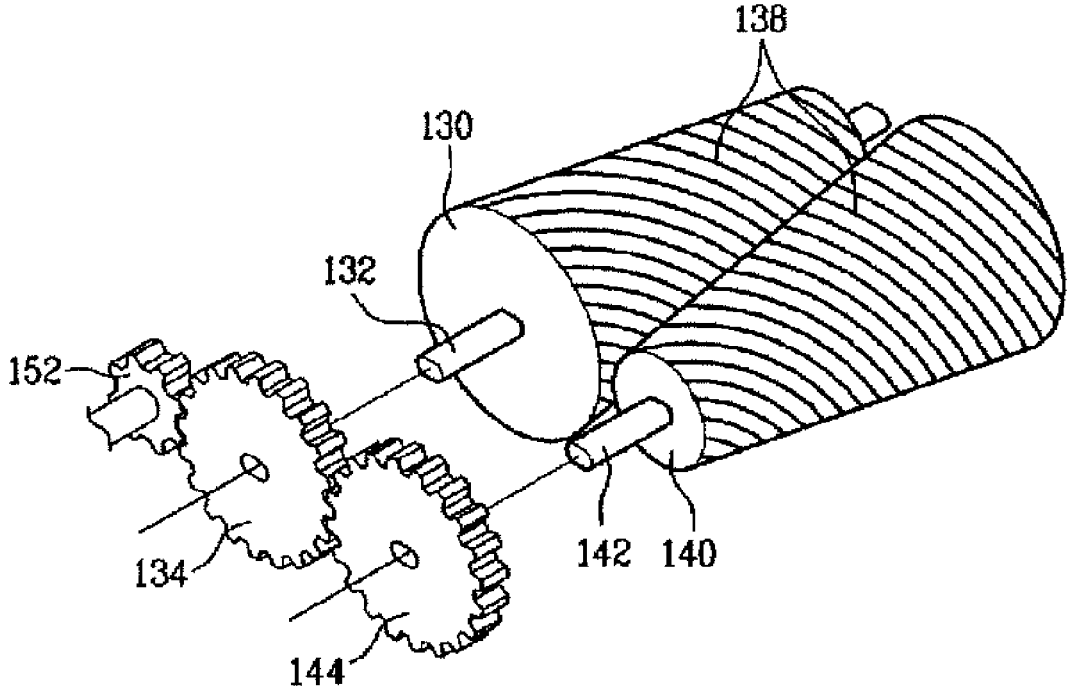
FIG. 1 is a schematic perspective view illustrating an ice dispenser according to an embodiment.

FIG. 1 is a schematic perspective view illustrating an ice dispenser according to an embodiment.

Figure 3:
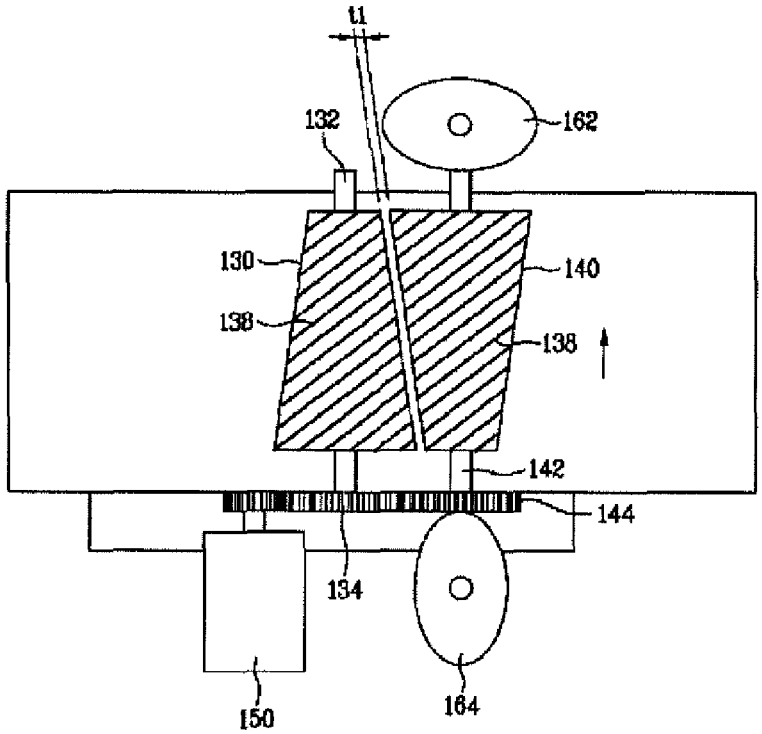
FIGS. 3 and 4 are plan views of the ice dispenser for comparing relative positions of a pair of rollers.

Referring to FIG. 1, the ice dispenser of the current embodiment includes an ice crusher and a driving unit 150 (refer to FIG. 3). The ice crusher includes a first roller 130 and a second roller 140. The driving unit 150 drives the first and second rollers 130 and 140. The first and second rollers 130 and 140 include first and second rotation shafts 132 and 142, respectively. The first and second rotation shafts 132 and 142 pass through centerlines of the first and second rollers 130 and 140 and may be parallel with each other.

The outer surface of the first roller 130 may be spaced a predetermined distance from the outer surface of the second roller 140. Ice crushing structures 138 can be formed on the outer surfaces of the first and second rollers 130 and 140 for finely crushing ice.

Figure 2:
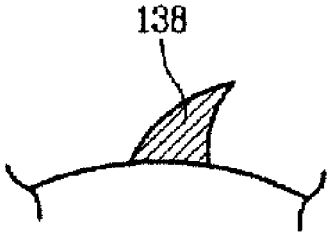
FIG. 2 is a partial sectional view illustrating an ice crushing structure according to an embodiment.

As shown in FIG. 2, the ice crushing structure 138 can be formed on one or both of the outer surfaces of the first roller 130 or the second roller 140 in the form of a spiral screw thread. When ice crushing structures 138 are formed on both of the outer surfaces of the first and second rollers 130 and 140, the ice crushing structures 138 can be inclined toward each other.

The driving unit 150 drives the first and second rollers 130 and 140. The driving unit 150 may be bidirectional. The driving unit 150 can include a motor. The motor can be bidirectional or unidirectional. When the motor is unidirectional, a direction change unit (not shown) can be provided to change rotating directions of the first and second rollers 130 and 140.

The driving unit 150 may further include a first driven gear 134 for transmitting power to the first roller 130, and a second driven gear 144 for transmitting power to the second roller 140. The first driven gear 134 and the second driven gear 144 are coupled to the first rotation shaft 132 and the second rotation shaft 142, respectively.

Here, the first and second rollers 130 and 140 may rotate in opposite directions. In this case, the first driven gear 134 and the second driven gear 144 rotate in opposite directions.

For this, the first and second driven gears 134 and 144 may be engaged with each other, and a driving gear 152 may be engaged with the first driven gear 134 for transmitting power from the driving unit 150 to the first driven gear 134. That is, the driving gear 152 rotates the first driven gear 134, and thus the second driven gear 144 rotates in a direction opposite to the rotation direction of the first driven gear 134 since the first and second driven gears 134 and 144 are engaged with each other.

Instead of engaging the first and second driven gears 134 and 144, the first and second driven gears 134 and 144 can be individually connected to the driving unit 150 and be rotated in opposite directions by individually receiving power from the from the driving unit 150. Besides the above-described structures of the first and second driven gears 134 and 144, other structures are available.

Figure 6:
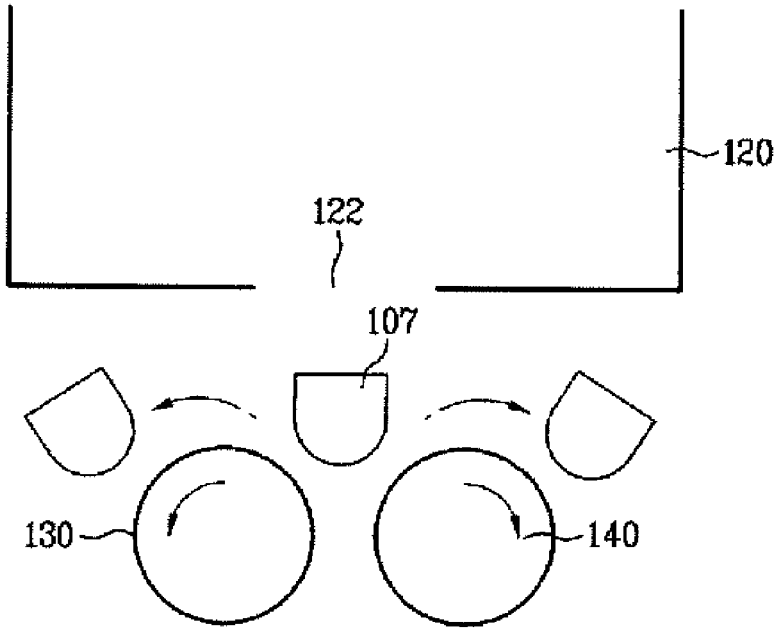
FIG. 6 is a view for explaining reverse rotation of the rollers.

When the first and second rollers 130 and 140 rotate in opposite directions as shown in FIG. 6 (hereinafter, referred to as reverse rotation or reverse directions), upper portions of the first and second rollers 130 and 140 move outward away from each other. In this case, ice chucks 107 fallen from an ice bank 120 are directed outside the first and second rollers 130 and 140, and thus the ice chucks 107 are not crushed before they are provided to a user.

Figure 7:
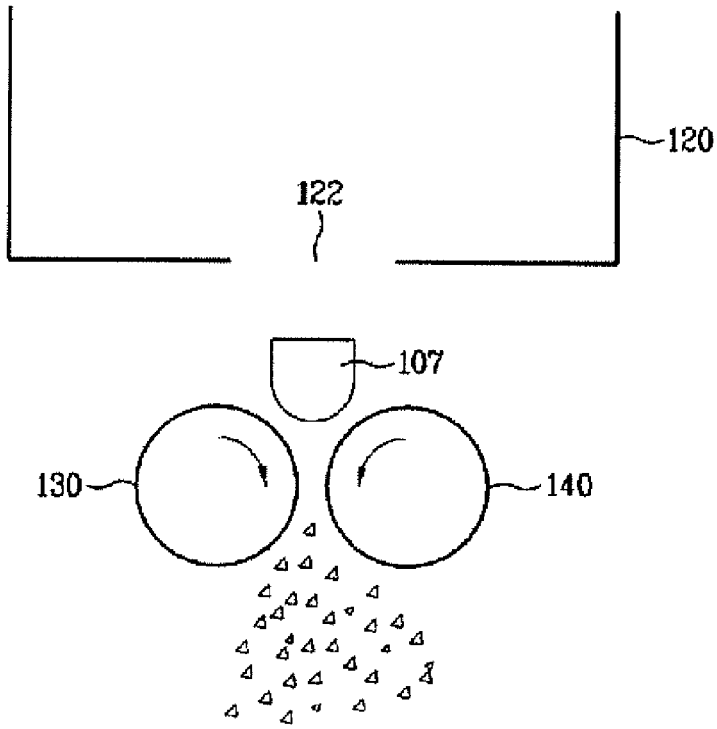
FIG. 7 is a view for explaining forward rotation of the rollers.

On the other hand, when the first and second rollers 130 and 140 rotate in opposite directions as shown in FIG. 7 (hereinafter, referred to as forward rotation or forward directions), upper portions of the first and second rollers 130 and 140 move toward each other. In this case, ice chucks 107 fallen from the ice bank 120 are directed between the first and second rollers 130 and 140, and thus the ice chucks 107 are crushed into smaller fragments or shavings. Here, the ice crushing structure 138 facilitates the crushing of the ice chucks 107.

Meanwhile, the distance between the outer surfaces of the first and second rollers 130 and 140 can be adjusted to vary the size of ice crushed between first and second rollers 130 and 140. The distance between the outer surfaces of the first and second rollers 130 and 140 can be adjusted by varying the distance between the first and second rotation shafts 132 and 142.

When the first and second rollers 130 and 140 have a conical shape, the distance between the outer surfaces of the first and second rollers 130 and 140 can be adjusted by moving one of the first and second rollers 130 and 140 in an axial direction.

In the current embodiment, the first and second rollers 130 and 140 have a conical shape. Thus, in the current embodiment, the distance between the outer surfaces of the first and second rollers 130 and 140 can be adjusted by moving one of the first and second rollers 130 and 140 in an axial direction. In detail, in the current embodiment, the conical first and second rollers 130 and 140 are arranged in parallel to each other in a manner such that the top of one of the conical first and second rollers 130 and 140 faces the base of the other. In addition, at least one of the first and second rollers 130 and 140 is movable in an axial direction for adjusting the distance between the outer surfaces of the first and second rollers 130 and 140.

In the current embodiment, the second roller 140 is axially movable.

Figure 5:
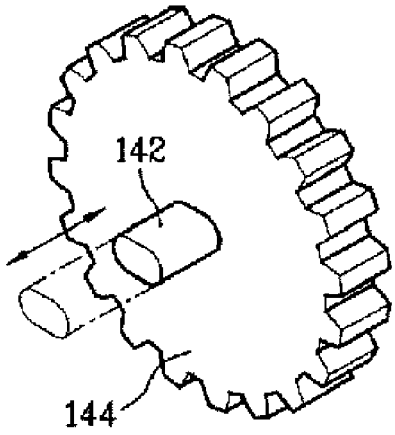
FIG. 5 is a view for explaining relative axial movement between a roller and a rotation shaft.

As shown in FIG. 5, the second driven gear 144, which is connected to the second roller 140 for transmitting power to the second roller 140, can be axially movable relative to the second rotation shaft 142 supporting the second roller 140. Therefore, although the second roller 140 moves axially, the engagement between the first and second driven gears 134 and 144 can be maintained, and thus power can be transmitted from the first driven gear 134 to the second roller 140 through the second driven gear 144. For example, a slot or serration structure can be used to couple the second driven gear 144 to the second rotation shaft 142 for allowing power transmission and relative axial movement between the second driven gear 144 and the second rotation shaft 142.

A distance adjustor is provided to adjust the distance between the first and second rollers 130 and 140.

Figure 4:
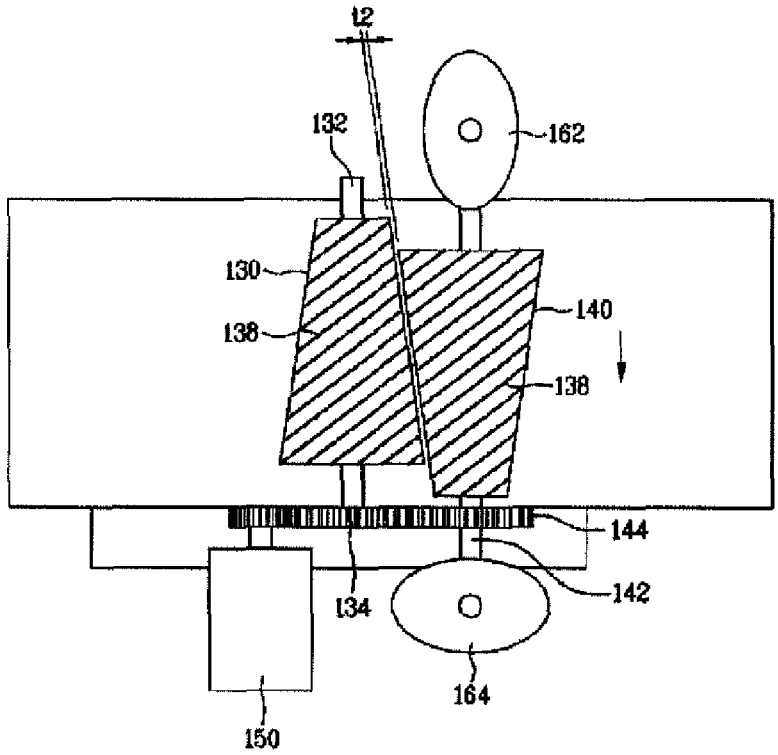

FIGS. 3 and 4 are plan views of the ice dispenser for comparing relative positions of a pair of rollers. The first and second rollers 130 and 140 are closer in FIG. 4 than in FIG. 3.

The distance adjustor can move the second roller 140 axially. For this, the distance adjustor includes cams 162 and 164 on both ends of the second rotation shaft 142.

The cams 162 and 164 may be set opposite in phase. In other words, when one of the cams 162 and 164 pushes the second rotation shaft 142, the other of the cams 162 and 164 does not push the second rotation shaft 142.

An exemplary operation of the ice dispenser will now be described.

When a user manipulate the ice dispenser for receiving ice chunks, a controller controls the driving unit 150 to rotate the first and second rollers 130 and 140 in reverse directions as shown in FIG. 6.

Then, since upper portions of the first and second rollers 130 and 140 rotate outward away from each other, ice chunks 107 transported from the ice bank 120 are guided outside the first and second rollers 130 and 140, and thus non-crushed ice chunks 107 can be dispensed.

On the other hand, when a user manipulate the ice dispenser for receiving crushed ice chunks, the controller controls the driving unit 150 to rotate the first and second rollers 130 and 140 in forward directions as shown in FIG. 7.

Then, since upper portions of the first and second rollers 130 and 140 rotate inward, ice chunks 107 transported from the ice bank 120 are guided between the first and second rollers 130 and 140, and thus the ice chunks 107 can be crushed into fragments or shavings. Therefore, crushed ice chunks 107 can be dispensed from the ice dispenser.

An exemplary operation of the ice dispenser for adjusting the size of crushed ice will now described.

When the ice dispenser is in the state of FIG. 3, the size of crushed ice may be relatively large, and when the ice dispenser is in the state of FIG. 4, the size of crushed ice may be relatively small.

Ice can be crushed into relatively large sizes by moving the second roller 140 backward (i.e., upward in FIG. 3) as shown in FIG. 3. Here, the cam 164 disposed at a front side of the second rotation shaft 142 pushes the second rotation shaft 142, and the cam 162 disposed at a rear side of the second rotation shaft 142 does not push the second rotation shaft 142. Therefore, the second rotation shaft 142 can be moved backward, and thus the second roller 140 can also be moved backward. As a result, a distance t1 between the first and second rollers 130 and 140 can be relatively large, and thus ice can be crushed into relatively large sizes.

On the other hand, ice can be crushed into relatively small sizes by moving the second roller 140 forward as shown in FIG. 4. Here, the cam 164 disposed at the front side of the second rotation shaft 142 does not push the second rotation shaft 142, and the cam 162 disposed at the rear side of the second rotation shaft 142 pushes the second rotation shaft 142. Therefore, the second rotation shaft 142 can be moved forward, and thus the second roller 140 can also be moved forward. As a result, a distance t2 between the first and second rollers 130 and 140 can be relatively small, and thus ice can be crushed into relatively small sizes.

When the distance between the first and second rollers 130 and 140 is sufficiently decreased, ice can be crushed into shavings.

Therefore, users can receive ice having desired sizes. For example, ice chunks, ice fragments, or ice shavings can be provided to users.

In the above-described embodiment, the driving unit 150 includes an electric motor. However, the driving unit 150 can be differently configured.

Figure 8:
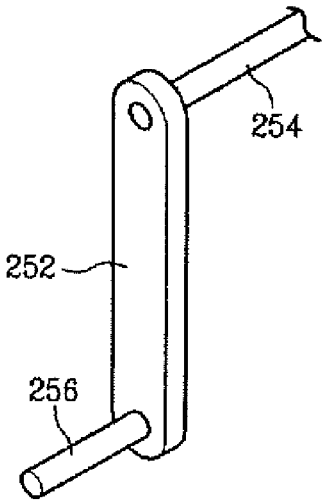
FIG. 8 is a view illustrating a driving unit according to another embodiment.

FIG. 8 is a view illustrating a driving unit according to another embodiment.

In the following description, the same elements as those of the previous embodiments will now be described for clarity.

In the current embodiment, the driving unit for the ice dispenser includes a rotatable shaft 254 and a crank 252. An end of the crank 252 is coupled to the rotatable shaft 254 such that a user can easily apply a torque to the rotatable shaft 254.

The rotatable shaft 254 can be coupled to a rotation shaft of the driving gear 152 or a rotation shaft of a gear (not shown) engaged with the driving gear 152. Alternatively, the rotatable shaft 254 can be directly coupled to the first driven gear 134.

The crank 252 is perpendicular to the rotatable shaft 254, and a handle 256 can be coupled to the other end of the crank 252 opposite to the rotatable shaft 254.

When a user rotates the handle 256, a torque can be transmitted to the first roller 130 and the second roller 140 through the first driven gear 134 and the second driven gear 144 so that the first and second rollers 130 and 140 can be rotated. The rotation directions of the first and second rollers 130 and 140 can be easily changed by rotating the handle 256 in an opposite direction.

As explained above, since the driving unit of the current embodiment is configured with the rotatable shaft 254 and the crank 252, electricity may be not necessary for the ice dispenser. Particularly, when the ice dispenser is used in other devices than a refrigerator, the ice dispenser can be easily fabricated and operated since the driving unit of the ice dispenser does not require electricity.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Mode for Invention

The present disclosure is not limited to the above-described embodiments. Other embodiments can be devised within the spirit and scope of the principles of this disclosure. Other embodiments of the present disclosure will now be described.

In the above-described embodiment, two cams 162 and 164 are respectively disposed on both ends of the second rotation shaft 142. However, according to another embodiment, a cam can be disposed on an end of the second rotation shaft 142, and a support member can be disposed at the other end of the second rotation shaft 142 for fixing the second rotation shaft 142 after the cam moves the second rotation shaft 142.

Furthermore, in the above-described embodiment, power is transmitted from the driving unit 150 to the first and second rollers 130 and 140 through gears. However, the present disclosure is not limited thereto. For example, in another embodiment, driving motors can be respectively connected to the first and second rollers 130 and 140 for individually driving the first and second rollers 130 and 140. In another embodiment, a bidirectional motor can be used to rotate the first and second rollers 130 and 140 for saving costs.

In addition, in the above-described embodiment, the distance between the first and second rollers 130 and 140 is adjusted by axially moving one of the first and second rollers 130 and 140 so as to adjust the size of crushed ice. However, the distance between the first and second rollers 130 and 140 can be adjusted in different manners. For example, the distance between the first and second rollers 130 and 140 can be adjusted by transversely moving one of the first and second rollers 130 and 140 toward or away from the other. Meanwhile, when the distance between the first and second rollers 130 and 140 is adjusted by axially moving one of the first and second rollers 130 and 140, the ice dispenser can have a simple structure.

According to the present disclosure, the ice dispenser can dispense ice pieces have various sizes such as chunks, fragments, and shavings to users. Furthermore, the ice dispenser can be manually operated without electricity such that users can receive ice pieces having a predetermined size such as shavings from the ice dispenser at a place where electricity is not available. Moreover, the size of ice pieces discharged from the ice dispenser can be easily adjusted such that the ice dispenser can be conveniently used.

What is claimed is:

1. An ice dispenser comprising:

an ice bank configured to store ice and including an ice outlet at a predetermined side;

a driving unit capable of rotating in forward and reverse directions;

an ice crusher including a first roller and a second roller, the first roller and the second roller being coupled to the driving unit to rotate the first roller and the second roller; and a distance adjustor configured to adjust a distance between the outer surfaces of the first and second rollers, wherein the ice crusher is configured to receive ice from the ice bank through the ice outlet, deliver the received ice without crushing the received ice by rotating the first roller and the second roller outwardly away from each other, and crush the received ice by rotating the first roller and second roller inwardly, wherein the first and second rollers are shaped like a cone and are disposed in parallel to each other, and an ice crushing structure is disposed on outer surfaces of the first and second rollers, wherein at least one of the first and second rollers is movable in a length direction of a rotation shaft thereof, and wherein the distance adjustor comprises a cam disposed on an end of the rotation shaft of the movable roller to axially move the rotation shaft for adjusting the distance between the outer surfaces of the first and second rollers.

2. The ice dispenser according to claim 1, wherein the cam is provided on one or both ends of the rotation shaft of the movable roller.

3. The ice dispenser according to claim 2, wherein cams are disposed on both sides of the rotation shaft of the movable roller, respectively, and the cams are set opposite in phase.

4. The ice dispenser according to claim 1, wherein an ice crushing structure is disposed on an outer surface of at least one of the first and second rollers.

5. The ice dispenser according to claim 1, wherein the first and second rollers rotate in opposite directions.

6. The ice dispenser according to claim 1, wherein the ice dispenser discharges ice in different states depending on whether the driving unit rotates in the forward direction or the reverse direction.

7. The ice dispenser according to claim 1, wherein the driving unit comprises:

a motor providing a torque;

a first driven gear rotatable by the motor and coupled to a rotation shaft of the first roller for rotating the first roller; and a second driven gear rotatable by the motor and coupled to a rotation shaft of the second roller for rotating the second roller.

8. The ice dispenser according to claim 7, wherein at least one of the first and second driven gears is movable relative to the corresponding rotation shaft in a length direction of the corresponding rotation shaft.

9. The ice dispenser according to claim 1, wherein the driving unit comprises:

a rotatable shaft;

a crank having an end coupled to the rotatable shaft and configured for a user to apply a torque to the rotatable shaft;

a first driven gear rotatable by the rotatable shaft and coupled to a rotation shaft of the first roller for rotating the first roller; and a second driven gear rotatable by the first driven gear and coupled to a rotation shaft of the second roller for rotating the second roller.

10. An ice dispenser comprising:

a rotatable first roller;

a rotatable second roller disposed close to the first roller; and a distance adjustor configured to adjust a distance between the first and second rollers for adjusting sizes of ice crushed between the first and second rollers, wherein at least one of the first and second rollers is movable in a length direction of a rotation shaft thereof, wherein the distance adjustor comprises a cam disposed on an end of the rotation shaft of the movable roller to axially move the rotation shaft for adjusting the distance between the outer surfaces of the first and second rollers.

11. The ice dispenser according to claim 10, wherein the distance adjustor comprises:

a cam on an end of at least one of the first and second rollers; and a support member on the other end of the at least one of the first and second rollers.

12. The ice dispenser according to claim 11, wherein the support member is a cam, wherein the cams are set opposite in phase.

* * * * *